US010588192B2

(12) United States Patent
Rashidi Doust

(10) Patent No.: US 10,588,192 B2
(45) Date of Patent: Mar. 10, 2020

(54) MULTI-COLOR LIGHT FIXTURES

(71) Applicant: ELITE LIGHTING, Commerce, CA (US)

(72) Inventor: Hamid Rashidi Doust, Beverly Hills, CA (US)

( * ) Notice: Subject to any disclaimer, the term of this patent is extended or adjusted under 35 U.S.C. 154(b) by 0 days.

(21) Appl. No.: 15/974,598

(22) Filed: May 8, 2018

(65) Prior Publication Data

US 2019/0350061 A1 Nov. 14, 2019

(51) Int. Cl.

| | |
|---|---|
| ***H05B 33/08*** | (2020.01) |
| ***F21S 10/02*** | (2006.01) |
| ***H05B 37/02*** | (2006.01) |
| *F21Y 115/10* | (2016.01) |
| *F21Y 113/10* | (2016.01) |

(52) U.S. Cl.
CPC ..... *H05B 33/0857* (2013.01); *F21S 10/02* (2013.01); *H05B 37/02* (2013.01); *F21Y 2113/10* (2016.08); *F21Y 2115/10* (2016.08)

(58) Field of Classification Search
CPC ..... H05B 33/0857; H05B 37/02; F21S 10/02; F21Y 2113/10; F21Y 2115/10
See application file for complete search history.

(56) References Cited

U.S. PATENT DOCUMENTS

| | | | | |
|---|---|---|---|---|
| 2008/0203948 | A1* | 8/2008 | Wu | H05B 33/0821 315/320 |
| 2014/0232288 | A1* | 8/2014 | Brandes | H05B 33/0803 315/250 |
| 2017/0343723 | A1* | 11/2017 | Pi | F21V 17/10 |
| 2018/0206305 | A1* | 7/2018 | Van Winkle | H05B 33/0857 |
| 2018/0209614 | A1* | 7/2018 | Sperling | F21V 23/04 |
| 2018/0255617 | A1* | 9/2018 | Kido | H05B 33/086 |
| 2019/0075634 | A1* | 3/2019 | Cho | H05B 37/0272 |

FOREIGN PATENT DOCUMENTS

CN 207179429 U * 4/2018

* cited by examiner

*Primary Examiner* — Wei (Victor) Y Chan
*Assistant Examiner* — Henry Luong
(74) *Attorney, Agent, or Firm* — Payam Moradian

(57) ABSTRACT

Provided is a light fixture comprising: a) a body; b) a plurality of two or more different colored LED (Light emitting Diodes) light sources; and c) a switch for powering the colored LEDs; wherein the light fixture can be operated in at least two different mode, with a user having an option of change position of the switch to choose to power the LED with a first color or the LED with a second color. Provided is a light fixture comprising: a) a body; and b) on or more LED boards, each board having a plurality of first and a second colored LED light source, the two colors configured to blend to form a third color; c) a switch configured to allow a user to choose between powering the first light source, the second light source or both; wherein the user has the option to power the first light source only, the second light source only, or both the first and the second light source to produce a blended color that is different than the first and the second color.

10 Claims, 10 Drawing Sheets

MULTI-COLOR LIGHT FIXTURES

BACKGROUND SECTION OF THE INVENTION

Light fixtures, particularly those having LED lights, can product a certain colored lights. Depending on the needed lighting conditions and the taste of the consumer, the desired light color might vary. A contractor installing a light fixture may not have sufficient quantity of a fixture with a particular light. Additionally, after installation, a consumer may have limited options on changing the light fixture. There is a need in the art for a light fixture that solves the above mentioned problems

SUMMARY SECTION OF THE INVENTION

Provided is a light fixture comprising: a) a body; b) a plurality of two or more different colored LED (Light emitting Diode) light sources; and c) a switch for powering the colored LEDs; wherein the light fixture can be operated in at least two different mode, with a user having an option of change position of the switch to choose to power the LED with a first color or the LED with a second color. The user can operate the light fixture in three modes, with the first color only, the second color only, or both the first and the second color to obtain a blended color. The switch can be on outside of the body. The LEDs are placed on one or more LED boards. The LED switch is placed on the LED board. The switch can be accessible from a bottom of the fixture. The LED boards can be placed horizontally, with the LEDs pointing downward. The LED boards can be placed horizontally, with the LEDs pointing side-ways. The LED board can be round. One of the colored LEDs can be 3000 Kelvin. One of the colored LEDs can be 5000 Kelvin. One of the colored LED light sources are 3000 and 5000 Kelvin. The colored LED light sources can be selected from the two of: Soft White (2700K-3000K), Bright White/Cool White (3500K-4100K), and Daylight (5000K-6500K). The light fixture can have a circular body, a circular LED board with the plurality of LEDs placed at a first end of the body, a ballast housing placed at the first end of the body on top of the LED board, relative to the fixture facing downward, wherein the ballast housing further comprises a switch for selecting from three modes of lighting by powering the first colors LED, the second colored LED, or both. The light fixture can comprise a rectangular body with LED boards having the plurality of the LEDs placed in horizontal fashion on the body. The light fixture can be a troffer light fixture. The light fixture can be a circular recessed light fixture.

Provided is a light fixture comprising: a) a body; and b) on or more LED boards, each board having a plurality of first and a second colored LED light source, the two colors configured to blend to form a third color; c) a switch configured to allow a user to choose between powering the first light source, the second light source or both; wherein the user has the option to power the first light source only, the second light source only, or both the first and the second light source to produce a blended color that is different than the first and the second color. The switch can be on the LED board. The LED colors can be 3000 kelvin and 5000 kelvin.

The light fixture can comprise a rectangular body with LED boards having the plurality of the LEDs placed in horizontal fashion on the body. The light fixture can comprise a rectangular frame, a light guide, a diffuser, a rectangular LED board, a foam, and a backing to close the frame. The light fixture can comprise a circular frame, a light guide, a diffuser, a disc shaped electronic housing, a disc shaped LED board placed on its side, and a backing to close the frame.

Provided is a method for setting a light fixture to a particular light mode, comprising positioning a switch to power a first colored LED, a second colored LED, or both to obtain a blended light.

DETAILED SECTION OF THE INVENTION

Provided is a light fixture configured to allow a user or a contractor to choose between two or more differently colored light to be emitted from the light fixture. The light fixture has two different colored lights 2A, 2B that can also blend together to create a third blended color. A user or a contractor can use a switch to set the light fixture to the first color, the second color, or the blend color.

Figure 1:
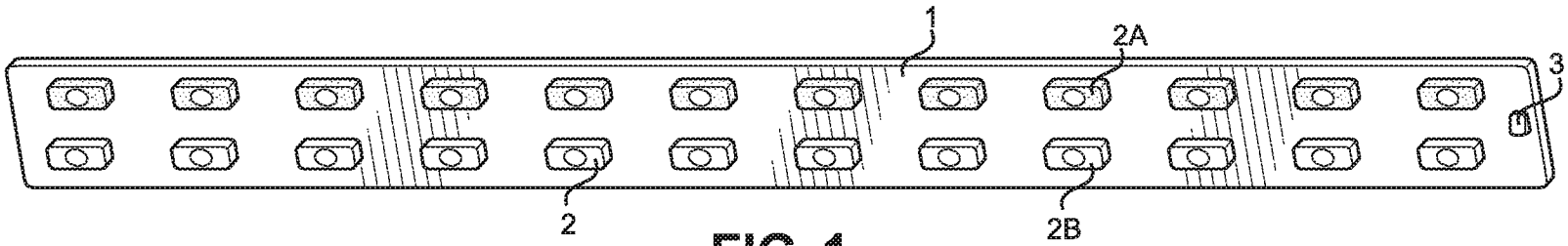
FIG. 1 illustrates a linear LED board with two differently colored LEDs attached thereto.

FIG. 1 illustrates a rectangular LED Printed Circuit Board (PCB). Two rows of different colored LEDs 2 are present on this board. As illustrated, one color occupies one row and the other color the second row. In another arrangement, the arrangement of the LED lights 2 according to color can be more random and mixed. Instead of one linear row, additional LED's 2 can be off-set in the row.

Figure 2:
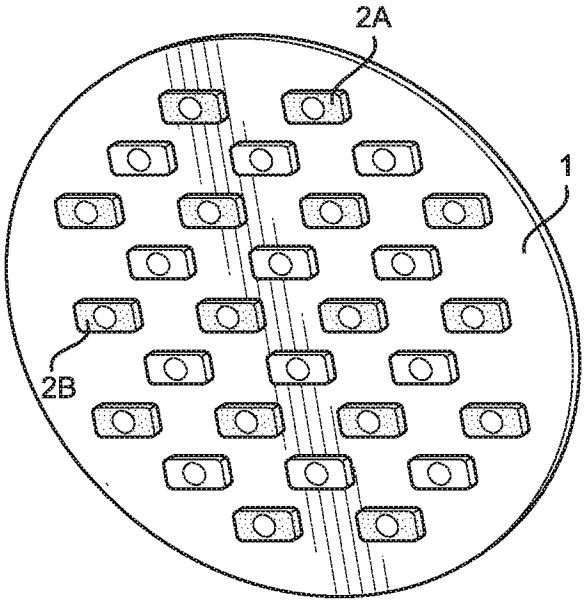
FIG. 2 illustrates a circular LED board with two differently colored LEDs attached thereto.

FIG. 2 illustrates a circular board 1 with two different colored LEDs 2A, 2B attached thereto. A user or contractor can turn on one of the colored LEDs 2 or both to create a blended color. The placement of the LEDs 2 on the board 1 can be ordered or random.

Figure 3:
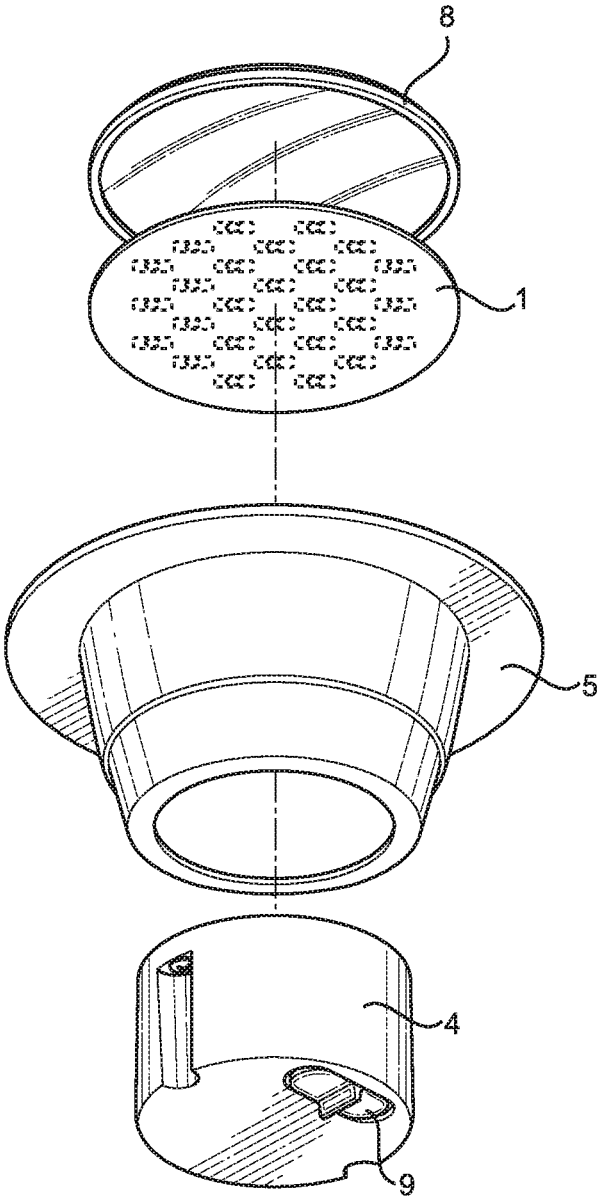
FIG. 3 illustrates an exploded view of a circular recessed light with a circular LED board.
Figure 11:
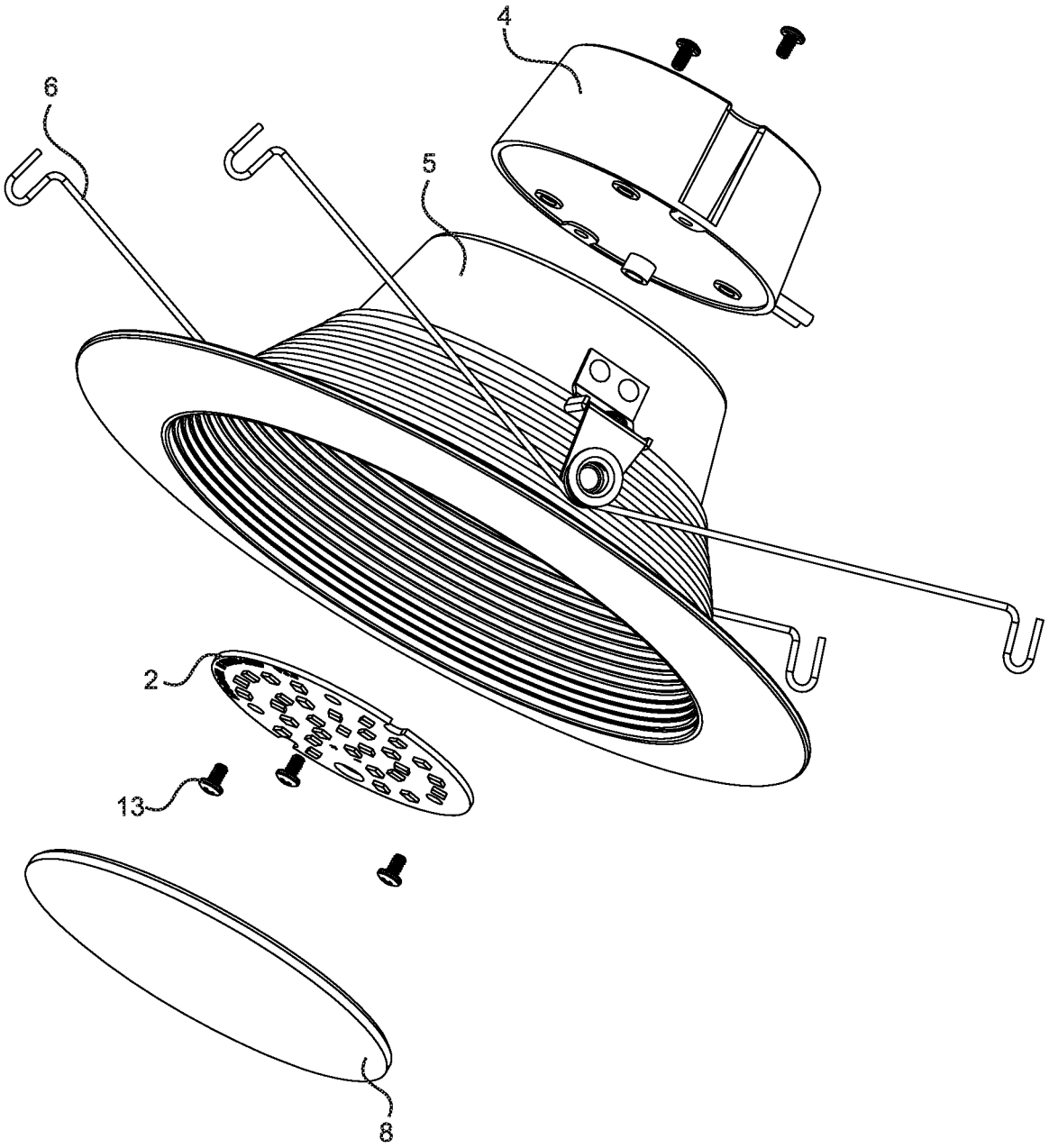
FIG. 11 illustrates a recessed circular light fixture.

FIGS. 3 and 11 illustrate a recessed light fixture with a circular board 1 plurality of multi-colored LEDs 2. The LED board 1 of FIG. 2 is placed in the circular recessed light fixture. The light fixture can have an electronics-housing 4 for placement of electronics, such as a ballast. A physical switch 9 can be placed on top of the electronics housing 4 so that a contractor or a user can set the switch 9 to power one or both type of colored LEDs 2. The recessed light can have a trim (not illustrated), and a lens 8 or other transparent/translucent cover over the LED board. FIG. 11 illustrates additional features of the recessed light fixture. For example, the recessed light fixture can have one or more extending arms 6 (with or without spring) for attaching the fixture to the ceiling. Fasteners 13 can be used to attach the LED board 1 to electronic homing 4.

Figure 4:
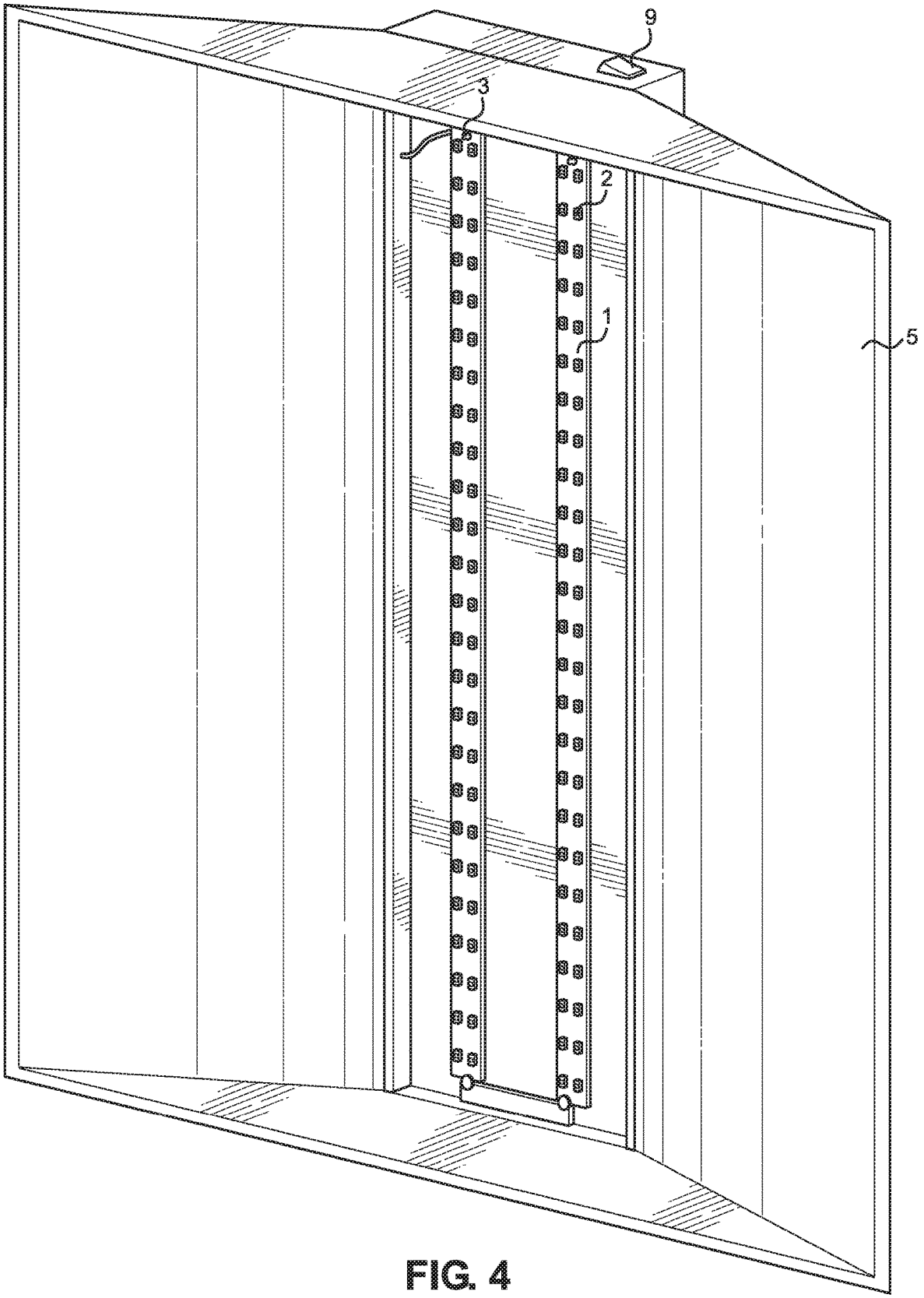
FIG. 4 illustrates a troffer light fixture with two LED boards.

FIG. 4 illustrates a troffer light housing and two parallel LED boards 1 placed against the bottom side of the housing. The LED boards 1 can have LEDs 2A, 2B of two different colors. For example, each board can have two different types of LEDs 2A, 2B. There can be a single switch 3 on one of the LED boards or each board can have its own switch. Alternatively, the switch 9 can be on the top or side of the housing. The switch 9 can turn on any one type of the LEDs 2A, 2B or both type of the LEDs 2A, 2B. A cover/lens (not illustrated) is placed on the boards 1. The cover is removable from the bottom and a user can remove the cover and change the switch 3 setting if needed. Alternatively, a contractor can select one of the three modes, and attach the cover/lens/diffuser.

Figure 5:
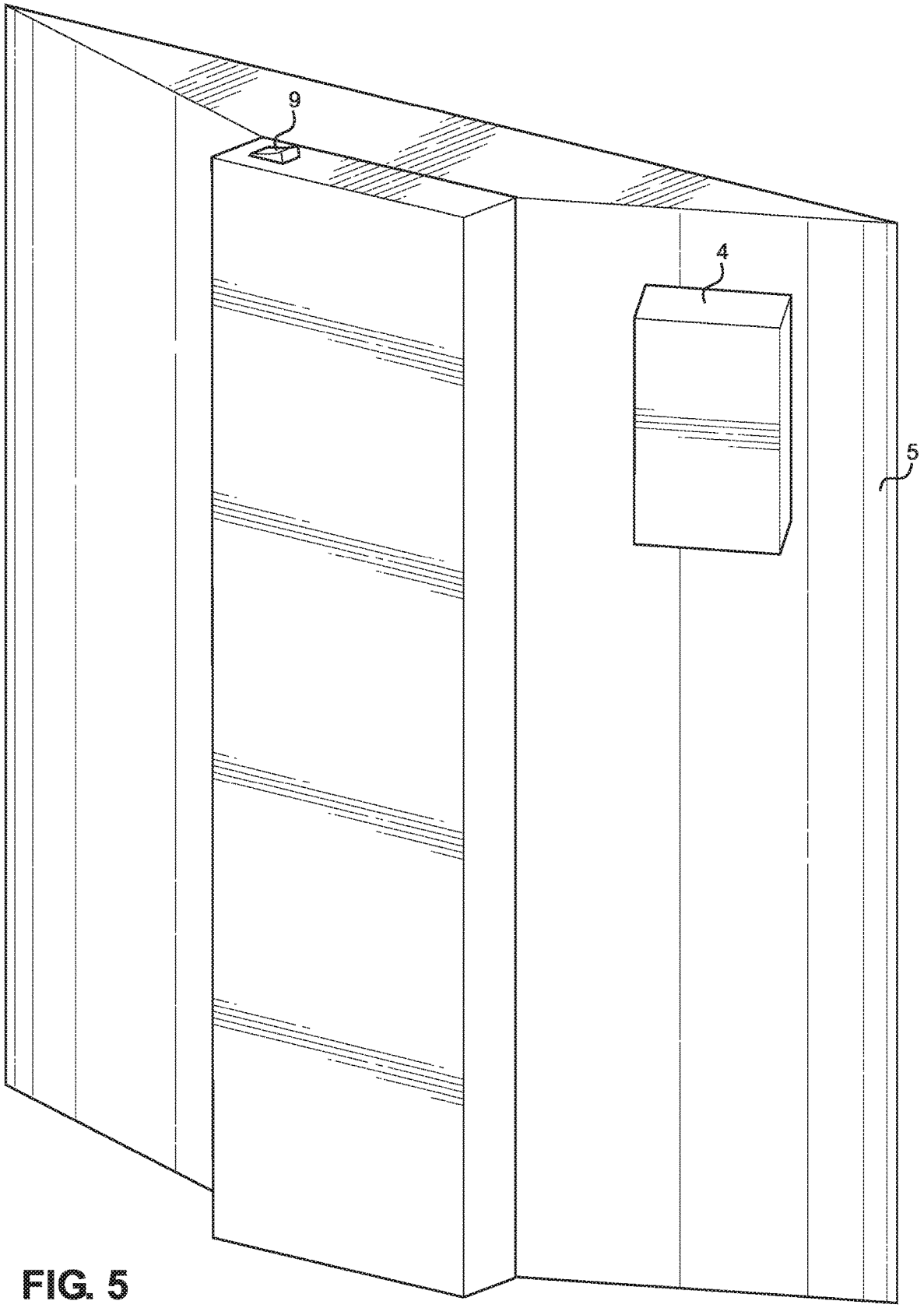
FIG. 5 illustrates the top of the troffer light fixture of FIG. 4.

FIG. 5 illustrates the back of the troffer light. An electronic-housing 4 having a ballast therein can be placed on top of the body 5. The body 4 can also have hooks or openings and/or brackets for attachment of the troffer to the ceiling. The switch 9 can be placed on the sides or top of the body 5.

Figure 6:
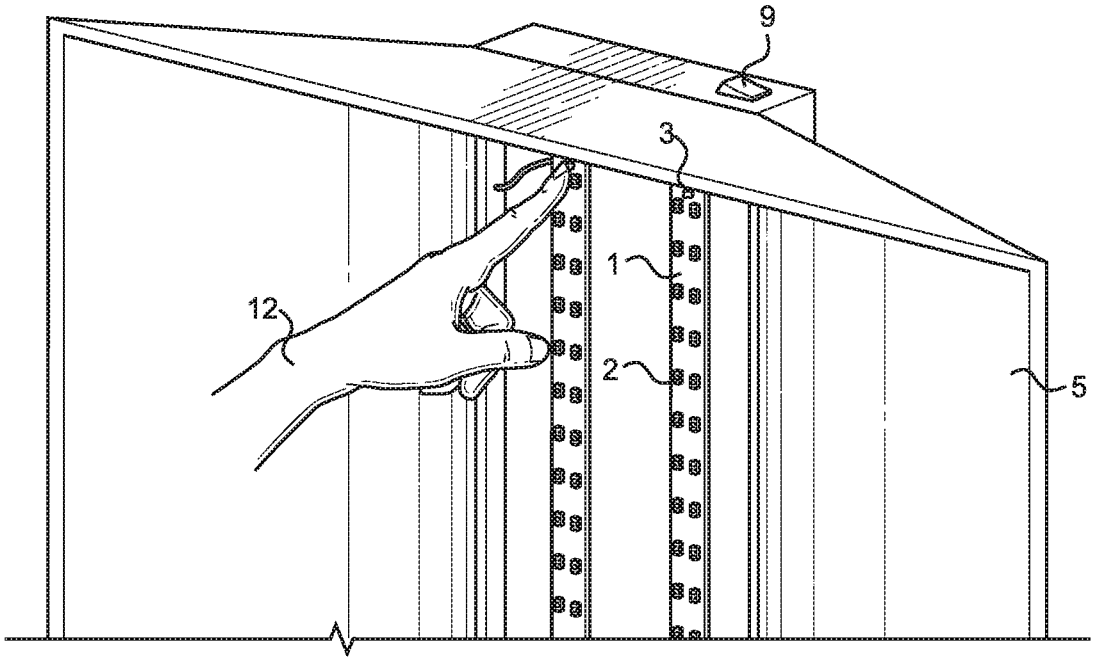
FIG. 6 illustrates a user adjusting a switch on the LED board (PCB Board) from the bottom of the troffer light fixture.

FIG. 6 illustrates a user accessing the troffer light fixture from the bottom and setting the switch 3 to a desired position Typically there is a removable lens covering the troffer body 5 on the bottom. A user 12 can remove the lens and re-set the switch 3.

Figure 7:
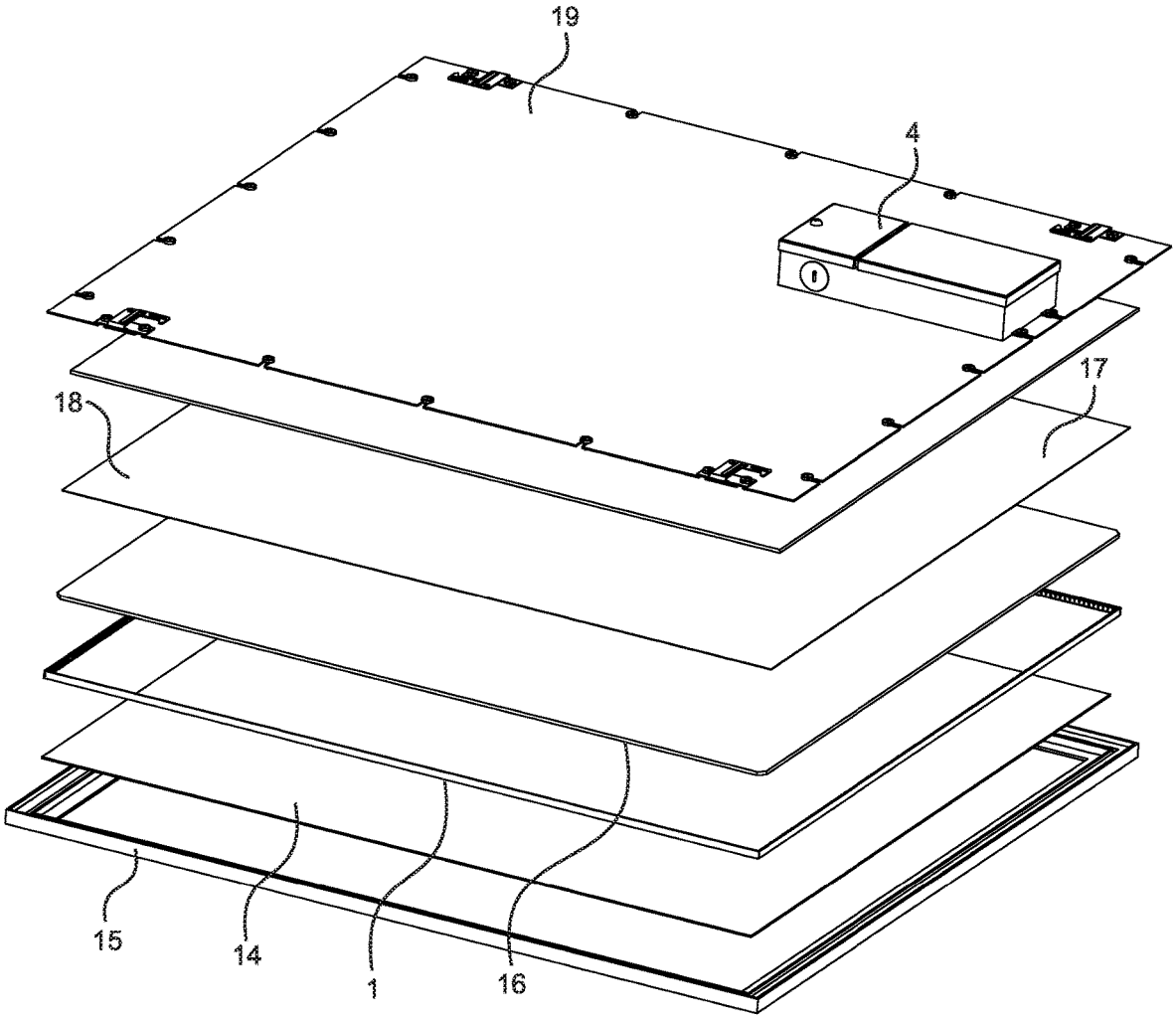
FIG. 7 illustrates a flat rectangular light fixture where a rectangular LED board is placed against the frame of the fixture.

FIG. 7 illustrates a flat rectangular light fixture. The LED board 1 is rectangular and is placed inside the frame 15, with the two parallel boards 1 placed against the wall of the body, usually in parallel configuration against the width. The LED board 1 can be placed on its sides.

Lens 16 and diffuser 14 are placed on the bottom of the fixture. Diffuser 14 can be a film. The film can be made of vinyl and can filter the color/amount of light from light guide 16.

A reflective sheet 17 can be placed on top of frame 15. The reflective sheet 17 can be a white glossy sheet to reflect the light going upward in a downward direction and absorb minimal amount of light. The color and texture of the reflective sheet 17 can be changed if a user seeks to change the color or intensity of the light.

A metal back plate 19 can be placed on top of the frame 15 to enclose the light fixture from the top. The metal can be aluminum. The metal back plate 19 can be a rectangular or a square piece of metal.

A foam 18 can be placed in between the reflective sheet 17 and metal plate 19. A layer of foam 18 allows for keeping the reflective sheet 17 straight and in position, and/or deflect the light downward.

Fastener (Screw) 13 can be placed from top of the fixture though openings in metal plate 19.

Ballast Room 4 can house the electronic from the light fixture, such as a power management unit that received electricity from an external source (outlet) and then directs electricity to each of the LED strips in a suitable form. The ballast room 4 can be attached to metal plate 19.

Figure 8:
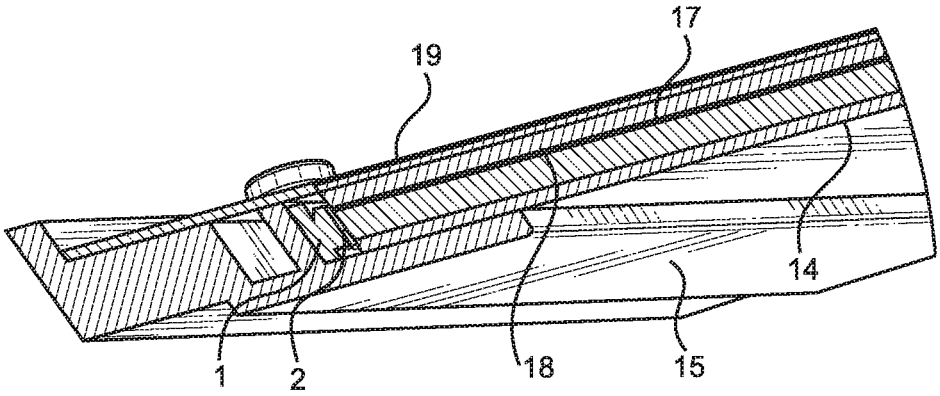
FIG. 8 illustrates a portion of the flat rectangular light fixture.

FIG. 8 illustrates the placement of the LED 2 against lens 16. LED 2 placed directly in front of light guide 16. LED 2 is placed directly in front of light guide 6, which can be a sheet of glass or other transparent material. The height of LED 2 is same or smaller than the height of light guide 16 so that all the light would enter light guide 16. Each straight portion of the LED board 1, which has multiple LEDs 2, lights up the light guide 16 from one side. Frame 15 and backing plate 19 can be made from aluminum.

Figure 9:
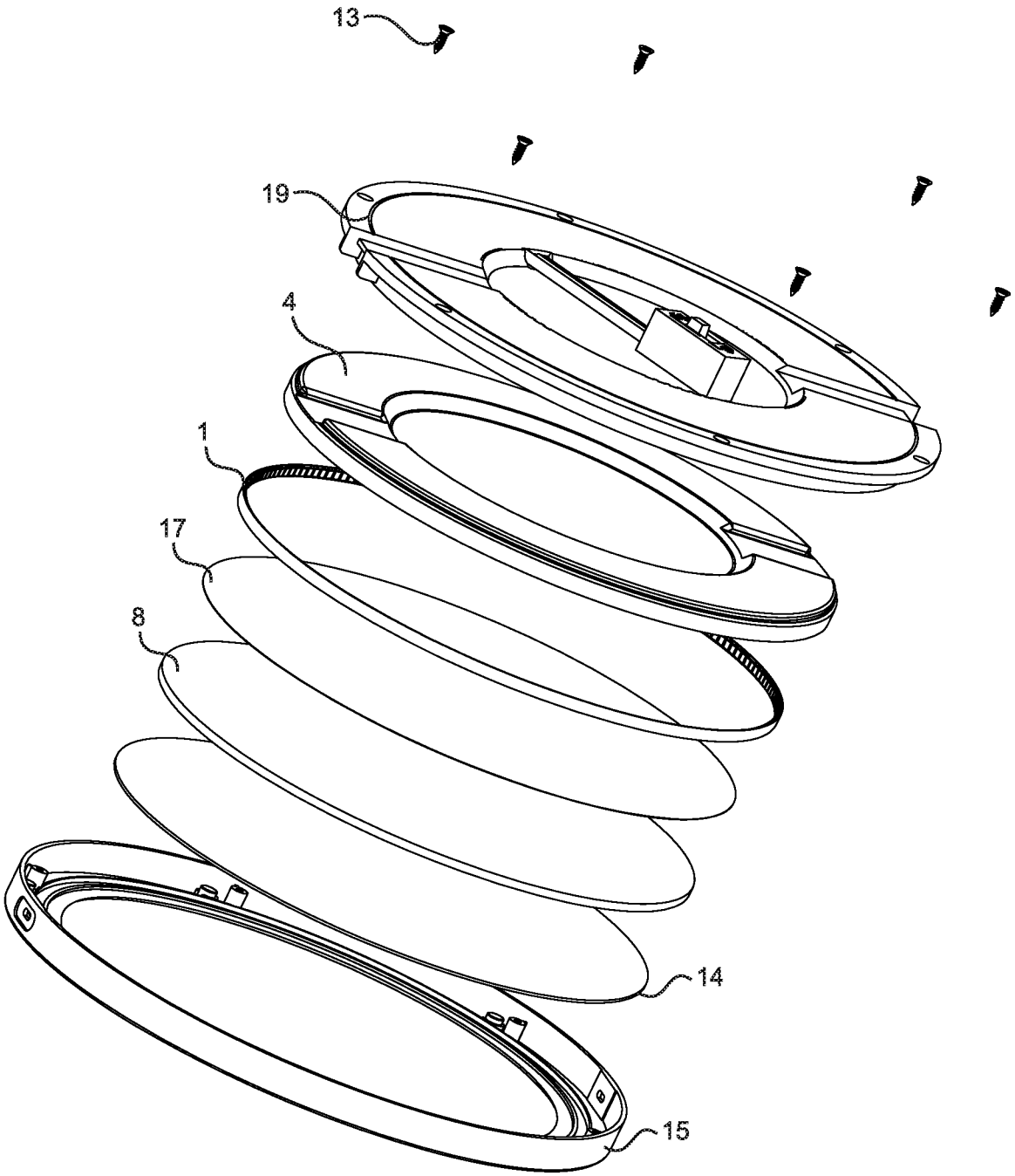
FIG. 9 illustrates a flat circular light fixture with a disc shaped LED board.

FIG. 9 illustrates a flat circular light fixture. The light fixture has a circular frame 15, lens 8, diffuser 14, reflective sheet 17, disc shaped LED board 1, ballast housing 4, and top plate 19. The components of the light fixture can be fastened together with fastener 13 from top of the fixture. Light from multiple colored LED's 2 leave the body of the fixture though lens 8 and diffuser 14.

Figure 10A:
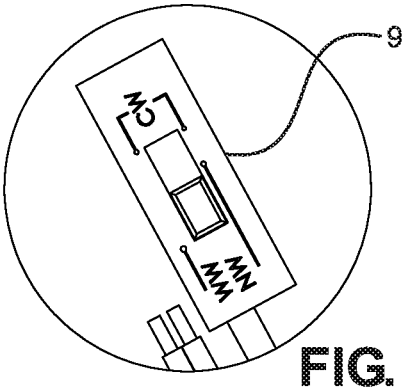
FIG. 10A illustrates a switch with three modes.
Figure 10B:
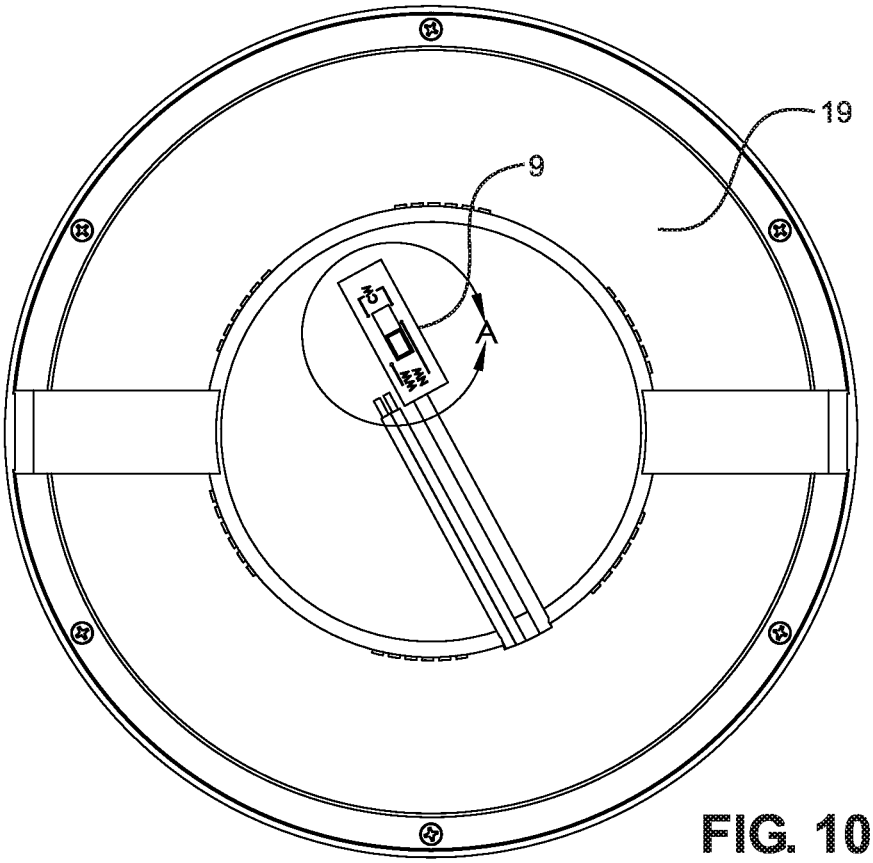
FIG. 10B illustrates a switch with three modes on top of the flat circular light fixture.

FIGS. 10A and 10B illustrate the top of the flat light fixture. Switch 9 with three modes is attached to the top of flat light fixture, to the top of the back plate 19. The switch is configured to turn LED 2A on only, LED 2B on only, or both LED 2A and 2B to create a blended color. The colored LED light sources 2 can be selected from two of: Soft White (2700K-3000K), Bright White/Cool White (3500K-4100K), and Daylight (5000K-6500K).

REFERENCES

1. LED Board
2. LED (2A first color and 2B second color)
3. Switch on LED Board
4. Electronics housing (ballast box)
5. Body
6. arms
8. Lens (Light Guide)
9. Switch on body
10. Body for troffer light
11. Ballast
12. user
14. Diffuser
15. Frame
16. Lens (light guide)
17. reflective sheet (white sheet)
18. Foam Pad
19. Back Plate

What is claimed is:

1. A light fixture comprising:

a) a body for attaching to a ceiling;

b) a rectangularly shaped LED board with a plurality of two, or more differently colored LED (Light emitting Diodes) light sources, wherein the rectangularly shaped LED board is placed horizontally, with the LEDs pointing downward;

c) a switch placed on the LED board for powering the plurality of the two, or more differently colored LED light sources; and d) an electronics housing containing a ballast placed on top of the body;

wherein the light fixture can be operated in at least two different mode, with a user having an option to change a position of the switch to choose to power the plurality of the two or more differently colored LED light sources having a first color or a second color;

wherein the switch is accessible from a bottom of the fixture.

2. The light fixture of claim 1, wherein the user can operate the light fixture in three modes, with the first color only, the second color only, or both the first and the second color to obtain a blended color.

3. The light fixture of claim 1, wherein one of the plurality of the two or more differently colored LEDs is 3000 Kelvin.

4. The light fixture of claim 1, wherein one of the plurality of the two or more differently colored LEDs is 5000 Kelvin.

5. The light fixture of claim 1, wherein the plurality of the two or more differently colored LED light sources are 3000 and 5000 Kelvin.

6. The light fixture of claim 1, wherein the light fixture comprises a rectangular body with the LED board having the plurality of the two or more differently colored LEDs placed in horizontal fashion on the body.

7. The light fixture of claim 1, wherein the light fixture comprises a rectangular frame a light guide, a diffuser, a rectangular LED board, a foam, and a backing to close the rectangular, frame.

8. The light fixture of claim 1, wherein the plurality of the two or more differently colored LED light sources are selected from the group consisting of two of: Soft White (2700K-3000K), Bright White/Cool White (3500K-4100K), and Daylight (5000K-6500K).

9. A light fixture comprising:

a) a body, and b) one or more rectangularly shaped LED boards, each board having a plurality of first and a second colored LED light sources for generating a first and a second color, both the first and the second colors configured to blend to form a third color, wherein the rectangularly shaped LED board is placed horizontally, with the LEDs pointing downward;

c) a switch on the one or more LED boards configured to allow a user to choose between powering the plurality of first colored light source, the plurality of second colored light source or both the first and the second colored LED light sources;

d) an electronics housing containing a ballast placed on top of the body;

wherein the user has the option to power the first colored LED light source only, the second colored LED light source only, or both the first and the second LED light sources to produce a blended color, the third color, that is different than the first and the second color.

10. The light fixture of claim 9, wherein the first LED color is 3000 kelvin and the second LED color is 5000 kelvin.

* * * * *